US005937544A

United States Patent [19]

Russell

[11] Patent Number: 5,937,544

[45] Date of Patent: Aug. 17, 1999

[54] ATHLETIC FOOTWEAR SOLE CONSTRUCTION ENABLING ENHANCED ENERGY STORAGE, RETRIEVAL AND GUIDANCE

[75] Inventor: Brian Russell, Littleton, Colo.

[73] Assignee: Britek Footwear Development, LLC, Boulder, Colo.

[21] Appl. No.: 08/903,130

[22] Filed: Jul. 30, 1997

[51] Int. Cl.[6] ..... A43B 13/18

[52] U.S. Cl. ..... 36/28; 36/27; 36/29

[58] Field of Search ..... 36/27, 28, 29, 36/3 B, 25 R

[56] References Cited

U.S. PATENT DOCUMENTS

| | | | |
|---|---|---|---|
| Re. 33,066 | 9/1989 | Stubblefield | 36/492 |
| D. 321,975 | 12/1991 | Arnulf et al. . | |
| D. 326,956 | 6/1992 | Damiande et al. | D2/320 |
| D. 331,832 | 12/1992 | Issler | D2/320 |
| D. 343,272 | 1/1994 | James | D2/953 |
| D. 347,105 | 5/1994 | Johnson | D2/952 |
| 1,382,180 | 6/1921 | Emery . | |
| 2,058,975 | 10/1936 | Gray . | |
| 2,549,343 | 4/1951 | Stoiner . | |
| 2,811,791 | 11/1957 | Cox | 36/76 |
| 3,086,532 | 4/1963 | Mistarz | 128/586 |
| 3,100,354 | 8/1963 | Lombard et al. | 36/25 |
| 3,290,801 | 12/1966 | Bente | 36/2.5 |
| 3,402,485 | 9/1968 | McMorrow | 36/25 |
| 4,259,792 | 4/1981 | Halberstadt | 36/28 |
| 4,266,349 | 5/1981 | Schmohl | 36/32 R |
| 4,335,530 | 6/1982 | Stubblefield | 36/83 |
| 4,372,058 | 2/1983 | Stubblefield | 36/32 R |
| 4,798,009 | 1/1989 | Colonel et al. . | |
| 4,922,631 | 5/1990 | Anderie | 36/102 |
| 5,005,299 | 4/1991 | Whatley | 36/25 R |
| 5,311,680 | 5/1994 | Comparetto | 36/154 |
| 5,319,866 | 6/1994 | Foley et al. | 36/91 |
| 5,367,791 | 11/1994 | Gross et al. | 36/31 |
| 5,384,973 | 1/1995 | Lyden | 36/25 R |
| 5,440,826 | 8/1995 | Whatley | 36/25 R |
| 5,465,507 | 11/1995 | Schumacher et al. | 36/30 R |
| 5,595,003 | 1/1997 | Snow . | |

FOREIGN PATENT DOCUMENTS

| | | |
|---|---|---|
| 92003069 | 3/1992 | WIPO . |

*Primary Examiner*—Ted Kavanaugh
*Attorney, Agent, or Firm*—Knobbe, Martens, Olson & Bear, LLP

[57] ABSTRACT

Athletic footwear has an upper and sole. The sole has heel and midfoot regions and metatarsel and toe regions which include a foundation layer of semi-flexible material attached to the upper and defining a plurality of stretch chambers, a stretch layer attached to the foundation layer and having portions of elastic stretchable material underlying the stretch chambers of the foundation layer, and a thrustor layer attached to the stretch layer and having portions of stiff material underlying and aligned with the stretch chambers of the foundation layer and with the portions of the stretch layer disposed between the thrustor layer and foundation layer such that interactions can occur between the foundation layer, stretch layer and thrustor layer in response to compressive forces applied thereto upon contact of the heel and midfoot regions and metatarsel and toe regions of the sole with a support surface so as to convert and temporarily store energy applied to heel and midfoot regions and metatarsel and toe regions of the sole by a wearer's foot into mechanical stretching of the portions of the stretch layer into the stretch chambers. The stored applied energy is thereafter retrieved in the form of rebound of the stretched portions of the stretch layer and portions of the thrustor layer therewith.

14 Claims, 5 Drawing Sheets

ATHLETIC FOOTWEAR SOLE CONSTRUCTION ENABLING ENHANCED ENERGY STORAGE, RETRIEVAL AND GUIDANCE

BACKGROUND OF THE INVENTION

1. Field of the Invention

The present invention generally relates to athletic footwear and, more particularly, is concerned with an athletic footwear sole construction having a combination of structural features enabling enhanced storage, retrieval and guidance of wearer muscle energy in a manner that complements and augments performance of participants in recreational and sports activities.

2. Description of the Prior Art

The increasing popularity of athletic endeavors has been accompanied by an increasing number of shoe designs intended to meet the needs of the participants in the various sports. The proliferation of shoe designs has especially occurred for the participants in athletic endeavors involving walking and running. In typical walking and running gaits, it is well understood that one foot is on the ground in a "stance mode" while the other foot is moving through the air in a "swing mode". Furthermore, in the stance mode, the respective foot "on the ground" travels through three successive basic phases; heel strike, mid stance and toe off.

Current shoe designs fail to adequately address the needs of the participant's foot and ankle system during each of these successive stages. Current shoe designs cause the participant's foot and ankle system to lose a significant proportion, by some estimates at least thirty percent, of its functional abilities including its abilities to absorb shock, load musculature and tendon systems, and to propel the runner's body forward. This is because the soles of current walking and running shoe designs fail to address individually the muscles and tendons of a participant's foot. The failure to individually address these foot components inhibits the flexibility of the foot and ankle system, interferes with the timing necessary to optimally load the foot and ankle system, and interrupts the smooth and continuous transfer of energy from the heel to the toes of the foot during the three successive basic phases of the "on the ground" foot travel.

Historically, manufacturers of modern running shoes added foam to cushion a wearer's foot. Then, gradually manufacturers developed other alternatives to foam-based footwear for the reason that foam becomes permanently compressed with repeated use and thus ceases to perform the cushioning function. The largest running shoe manufacturer, Nike Inc. of Beaverton, Ore., has utilized bags of compressed gas as the means to cushion the wearer's foot. A German manufacturer, Puma AG, has proposed a foamless shoe in which polyurethane elastomer is the cushioning material. Another running shoe manufacturer, Reebok International of Stoughton, Mass., recently introduced a running shoe which has two layers of air cushioning. Running shoe designers heretofore have sought to strike a compromise between providing enough cushioning to protect the wearer's heel but not so much that the wearer's foot will wobble and get out of sync with the working of the knee. The Reebok shoe uses air that moves to various parts of the sole at specific times. For example, when the outside of the runner's heel touches ground, it lands on a cushion of air. As the runner's weight bears down, that air is pushed to the inside of the heel, which keeps the foot from rolling inward too much while another air-filled layer is forcing air toward the forefoot. When the runner's weight is on the forefoot, the air travels back to the heel.

However, no past shoe designs, including the specific ones cited above, are believed to adequately address the aforementioned needs of the participant's foot and ankle system during walking and running activities in a manner that augments performance. The past approaches, being primarily concerned with cushioning the impact of the wearer's foot with the ground surface, fail to even recognize, let alone begin to address, the need to provide features in the shoe sole that will enhance the storage, retrieval and guidance of a wearer's muscle energy in a way that will complement and augment the wearer's performance during the walking, running and jumping activities.

Consequently, a pressing need still remains for improvements in sole construction for athletic footwear that will provide features that will enhance energy utilization.

SUMMARY OF THE INVENTION

The present invention provides an athletic foowear sole construction designed to satisfy the aforementioned needs. The athletic footwear sole of the present invention provides a combination of structural features under the heel, midfoot and forefoot regions of the wearer's foot that enable enhanced storage, retrieval and guidance of muscle energy in a manner that complements and augments wearer performance in sports and recreational activities. The sole construction of the present invention enables athletic footwear for walking, running and jumping to improve and enhance performance by complementing, augmenting and guiding the natural flexing actions of the muscles of the foot. The combination of structural features incorporated in the sole construction of the present invention provides unique control over and guidance of the energy of the wearer's foot as it travels through the three successive basic phases of heel strike, mid stance and toe off.

Accordingly, the present invention is directed to an athletic footwear having an upper and sole with the sole having heel, midfoot, metatarsel, and toe regions wherein the sole comprises a foundation layer of stiff material attached to the upper and defining a plurality of stretch chambers, a stretch layer attached to the foundation layer and having portions of elastic stretchable material underlying the stretch chambers of the foundation layer, and a thrustor layer attached to the stretch layer and having portions of stiff material underlying and aligned with the stretch chambers of the foundation layer and with the portions of the stretch layer disposed between the thrustor layer and foundation layer. Given the above-defined arrangement, interactions occur between the foundation layer, stretch layer and thrustor layer in response to compressive forces applied thereto upon contact of the heel and midfoot regions and metatarsel and toe regions of the sole with a support surface so as to convert and temporarily store energy applied to heel and midfoot regions and metatarsel and toe regions of the sole by a wearer's foot into mechanical stretching of the portions of the stretch layer into the stretch chambers of the foundation layer. The stored applied energy is thereafter retrieved in the form of rebound of the stretched portions of the stretch layer and portions of the thrustor layer therewith. Whereas components of the heel and midfoot regions of the sole provide temporary storage and retrieval of applied energy at central and peripheral sites underlying the heel and midfoot of the wearer's foot, components of the metatarsel and toe regions of the sole provide the temporary storage and retrieval of applied energy at independent sites underlying the individual metatarsals and toes of the wearer's foot.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
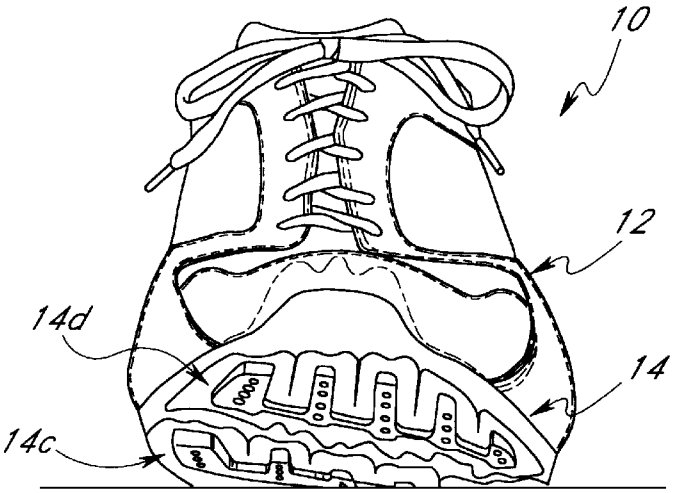
FIG. 2 is a front elevational view of the sole construction.
Figure 1:
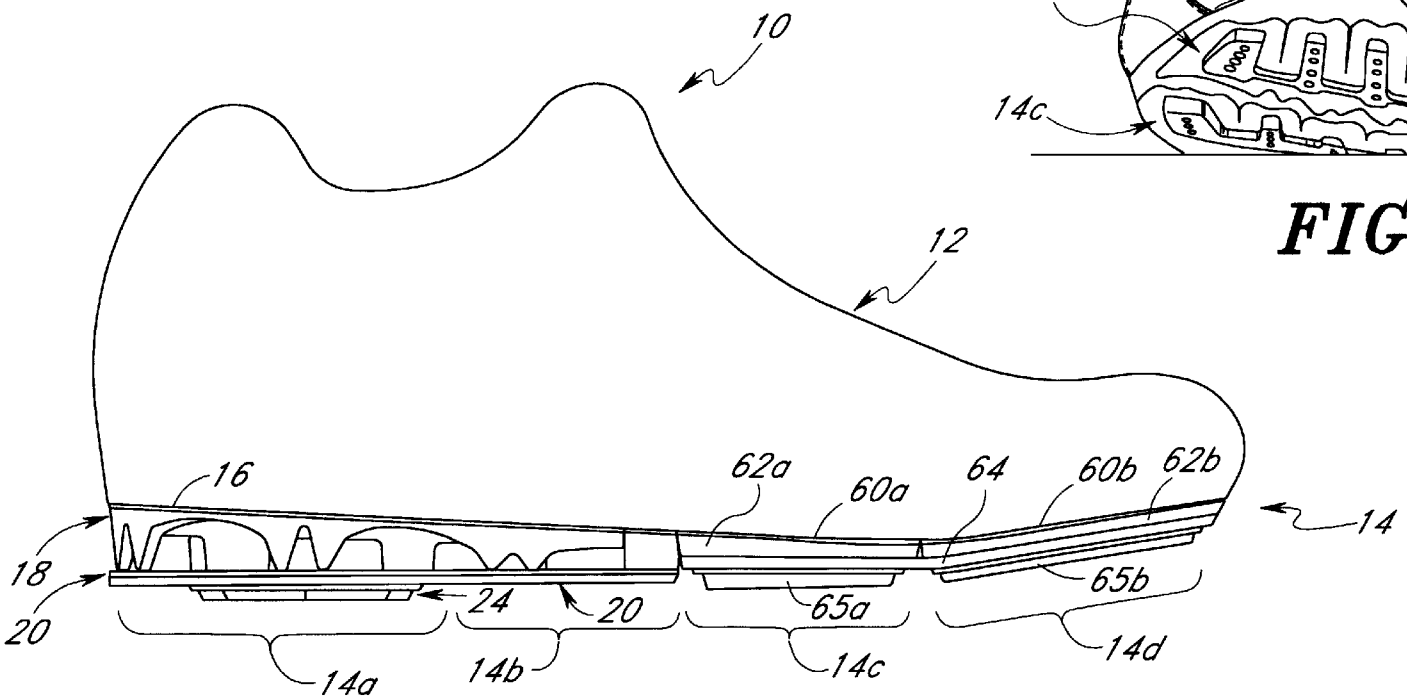
FIG. 1 is a side elevational view of an athletic footwear sole construction of the present invention.

Referring to the drawings and particularly to FIGS. 1 and 2, there is illustrated an article of athletic footwear for walking, running and/or jumping, being generally designated 10. The footwear 10 includes an upper 12 and a sole 14 having heel and midfoot regions 14A, 14B and metatarsel and toe regions 14C, 14D wherein are provided the structural features of the sole 14 constituting the present invention. The sole 14 incorporating the construction of the present invention improves the walking, running and jumping performance of a wearer of the footwear 10 by providing a combination of structural features which complements and augments, rather than resist, the natural flexing actions of the muscles of the foot to more efficiently utilize the muscular energy of the wearer.

Referring to FIGS. 1 and 3 to 8, the heel and midfoot regions 14A, 14B of the sole 14 basically includes the stacked combination of a footbed layer 16, an upper stretch layer 18, an upper thrustor layer 20, a lower stretch layer 22, and a lower thrustor layer 24. The footbed layer 16 of the sole 14 serves as a foundation for the rest of the stacked components of the heel and midfoot regions 14A, 14B. The footbed layer 16 includes a substantially flat foundation plate 26 of semi-rigid semi-flexible thin stiff material, such as fiberglass, whose thickness is chosen to predetermine he degree of flexion (or bending) it can undergo in response to the load that will be applied thereto.

The foundation plate 26 has a heel portion 26A and a midfoot portion 26B. The foundation plate 26 has a continuous interior lip 26C encompassing a central opening 28 formed in the foundation plate 26 which provides its heel portion 26A with a generally annular shape. The flat foundation plate 26 also has a plurality of continuous interior edges 26D encompassing a corresponding plurality of elongated slots 30 formed in the foundation plate 26 arranged in spaced apart end-to-end fashion so as to provide a U-shaped pattern of the slots 30 starting from adjacent to a forward end 26E of the foundation plate 26 and extending rearwardly therefrom and around the central opening 28. The slots 30 are slightly curved in shape and run along a periphery 26F of the foundation plate 26 but are spaced inwardly from the periphery 26F thereof and outwardly from the central opening 28 thereof so as to leave solid narrow borders respectively adjacent to the periphery 26F and the central opening 28 of the foundation plate 26. The slots 30 alone or in conjunction with recesses 32 of corresponding shape and position in the bottom of the shoe upper 12 define a corresponding plurality of peripheral stretch chambers 34 in the foundation plate 26.

The upper stretch layer 18 is made of a suitable elastic material, such as rubber, and includes a flexible substantially flat stretchable body 36 and a plurality of compressible lugs 38 formed on and projecting downwardly from the bottom surface 36A of the flat stretchable body 36 at the periphery 36B thereof. The peripheral profile of the flat stretchable body 36 of the upper stretch layer 18 generally matches that of the flat foundation plate 26 of the footbed layer 16. In the exemplary embodiment shown in FIGS. 1, 3 and 5 to 8, the compressible lugs 38 are arranged in a plurality of pairs thereof, such as six in number, spaced apart along opposite lateral sides of the flat stretchable body 36. Other arrangements of the compressible lugs 38 are possible so long as it adds stability to the sole 14. For ease of manufacture, the compressible lugs 38 are preferably integrally attached to the flat stretchable body 36.

The upper thrustor layer 20 disposed below and aligned with the upper stretch layer 18 includes a substantially flat support plate 40 preferably made of a a relatively incompressible, semi-rigid semi-flexible thin stiff material, such as fiberglass, having a construction similar to that of the flat foundation plate 26 of the footbed layer 16. The flat support plate 40 has a heel portion 40A and a midfoot portion 40B. The support plate 40 also has a continuous interior rim 40C surrounding a central hole 42 formed through the support plate 40 which provides its heel portion 40A with a generally annular shape. The central hole 42 provides an entrance to a space formed between the flat stretchable body 36 of the upper stretch layer 18 and the flat support plate 40 spaced therebelow which space constitutes a main central stretch chamber 44 of said sole 14. The peripheral profile of the upper thrustor layer 20 generally matches the peripheral profiles of the footbed layer 16 and upper stretch layer 18 so as to provide the sole 14 with a common profile when these components are in an operative stacked relationship with one on top of the other.

The upper thrustor layer 20 also includes a plurality of stretch-generating thrustor lugs 46 made of a relatively incompressible flexible material, such as plastics, and being mounted on the top surface 40D of the flat support plate 40 and projecting upwardly therefrom so as to space the flat support plate 40 below the flat stretchable body 36 of the upper stretch layer 18. The thrustor lugs 46 are arranged in a spaced apart end-to-end fashion which corresponds to that of the slots 30 in the foundation plate 26 so as to provide a U-shaped pattern of the thrustor lugs 46 starting from adjacent to a forward end 40E of the flat support plate 40 and extending rearward therefrom and around the central opening 42. The thrustor lugs 46 run along a periphery 40F of the support plate 40 but are spaced inwardly therefrom and outwardly from the central opening 42 of the support plate 40 so as to leave solid narrow borders respectively adjacent to the periphery 40F and the central opening 42 of the support plate 40. The peripherally-located thrustor lugs 46 thus correspond in shape and position to the peripherally-located slots 30 in the flat foundation plate 26 of the footbed layer 16 defining the peripherally-located stretch chambers 34. For ease of manufacture the thrustor lugs 46 are attached to a common thin sheet which, in turn, is adhered to the top surface 40D of the flat support plate 40.

The flat support plate 40 of the upper thrustor layer 20 supports the thrustor lugs 46 in alignment with the slots 30 and thus with the peripheral stretch chambers 34 of the foundation plate 26 and upper 12 of the shoe 10. However, the flat stretchable body 36 of upper stretch layer 18 is disposed between the stretch-generating thrustor lugs 46 and flat foundation plate 26. Thus, with the footbed layer 16, upper stretch layer 18 and upper thrustor layer 20 disposed in the operative stacked relationship with one on top of the other in the heel and midfoot regions 14A, 14B of the sole 14, spaced portions 36C of the flat stretchible body 36 of the upper stretch layer 18 overlie top ends 46A of the stretch-generating thrustor lugs 46 and underlie the peripheral stretch chambers 34. Upon compression of the footbed layer 16 and upper thrustor layer 20 toward one another from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface, the spaced portions 36A of the flat stretchable body 36 are forceably stretched by the upwardly movement of the top ends 46A of the thrustor lugs 46 upwardly past the interior edges 26D of the foundation plate 26 surrounding the slots 30 and into the stretch chambers 34. This can occur due to the fact that the thrustor lugs 46 are enough smaller in their footprint size than that of the slots 30 so as to enable their top ends 46A together with the portions 36A of the flat stretchable body 36 stretched over the top ends 46A of the thrustor lugs 46 to move and penetrate upwardly through the slots 30 and into the peripheral stretch chambers 34, as shown in FIGS. 7 and 8.

The compressible lugs 38 of the upper stretch layer 18 are located in alignment with the solid border extending along the periphery 26F of the foundation plate 26 outside of the thrustor lugs 46. The compressible lugs 38 project downwardly toward the support base 40. The compressive force applied to the foundation plate 26 of the footbed layer 16 and to the support plate 42 of the upper thrustor layer 20, which occurs during normal use of the footwear 10, causes compression of the compressible lugs 38 from their normal tapered shape assumed in the relaxed condition of the sole 14 shown in FIGS. 5 and 6, into the bulged shape taken on in the loaded condition of the sole 14 shown in FIGS. 7 and 8. In addition to adding stability, the function of the compressible lugs 38 is to provide storage of the energy that was required to compress the lugs 38 and thereby to quicken and balance the resistance and rebound qualities of the sole 14.

Figure 3:
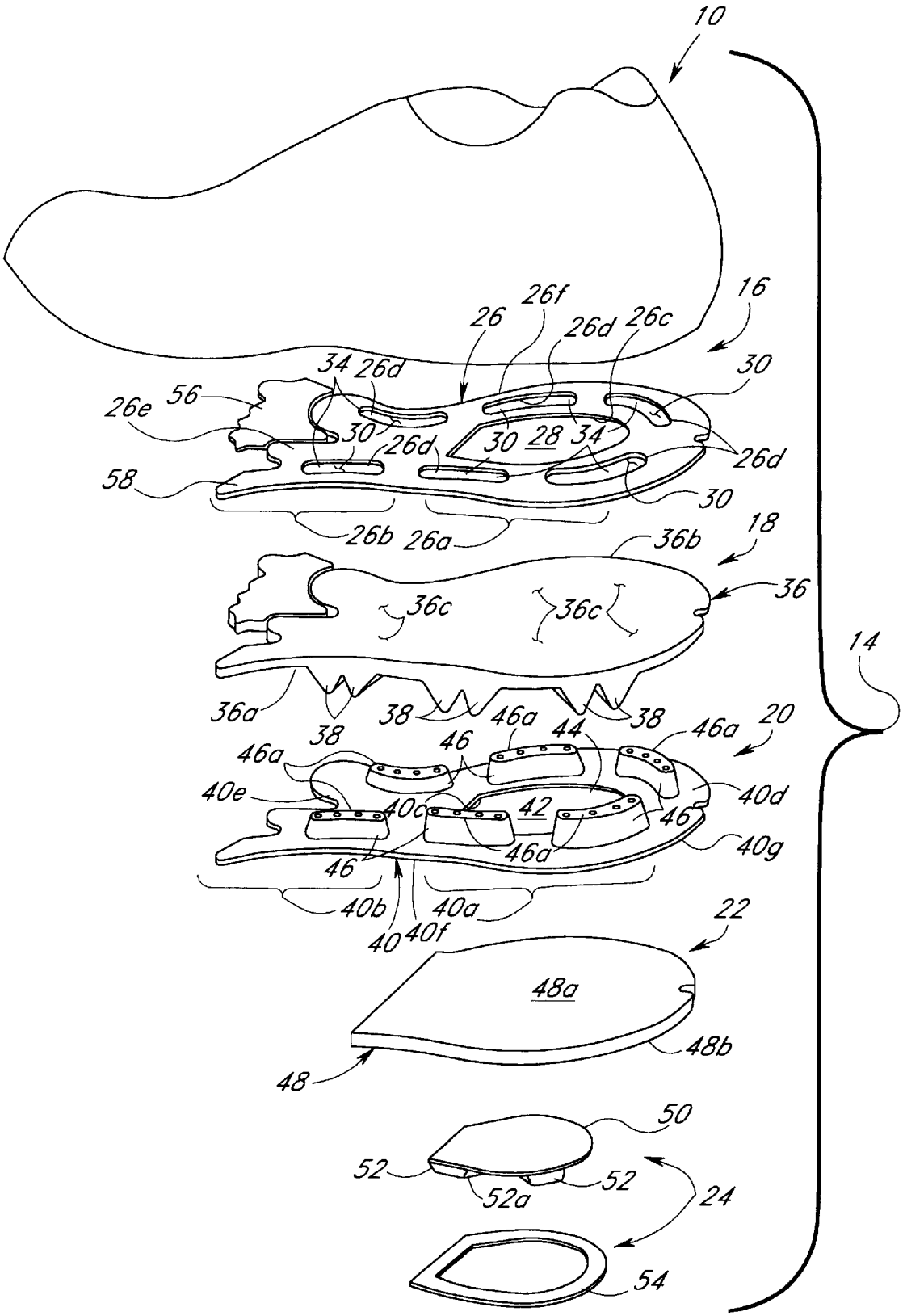
FIG. 3 is an exploded top perspective view of heel and midfoot regions of the sole construction of the present invention.
Figure 4:
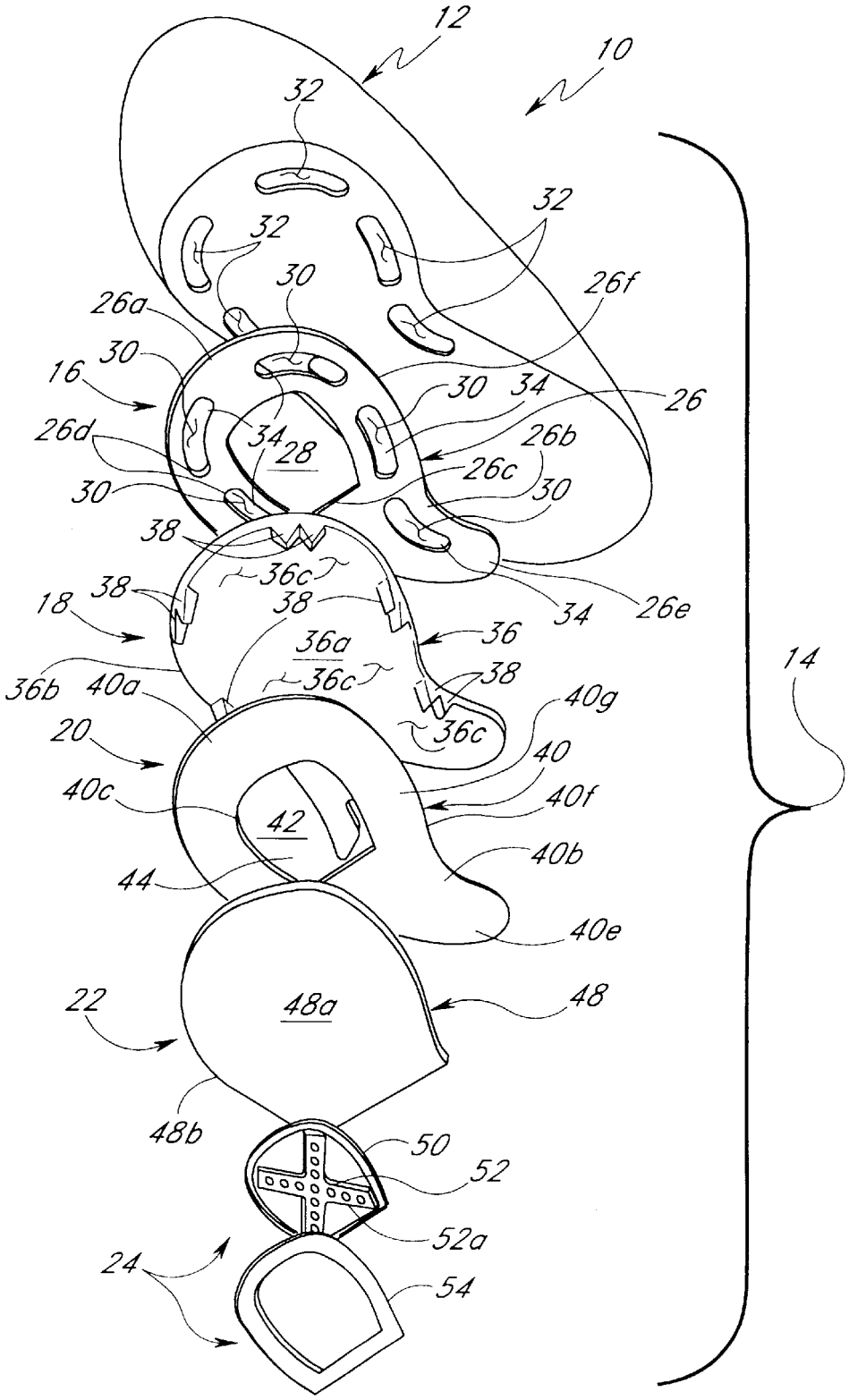
FIG. 4 is an exploded bottom perspective view of heel and midfoot regions of the sole construction.

As can best be seen in FIGS. 1 and 3, the stretch-generating thrustor lugs 46 are generally greater in height at the heel portion 40A of the support plate 40 than at the midfoot portion 40B thereof. This produces a wedge shape through the heel and midfoot regions 14A, 14B of the sole 14 from rear to front, that effectively generates and guides a forward and upward thrust for the user's foot as it moves through heel strike to mid stance phases of the foot's "on the ground" travel.

Figure 8:
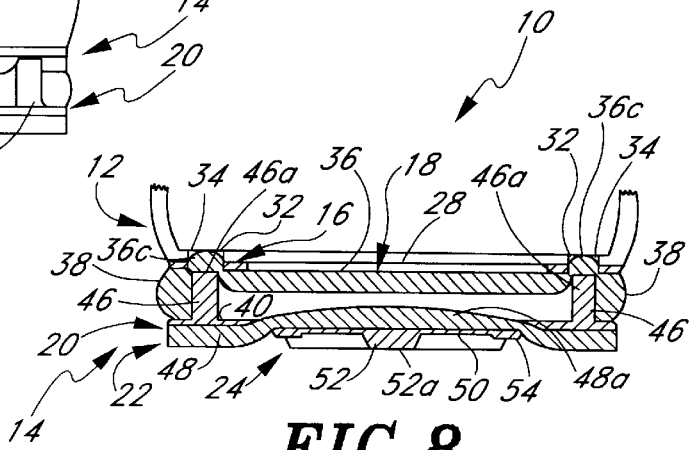
FIG. 8 is a vertical transverse sectional view of the sole construction of FIG. 7.
Figure 9:
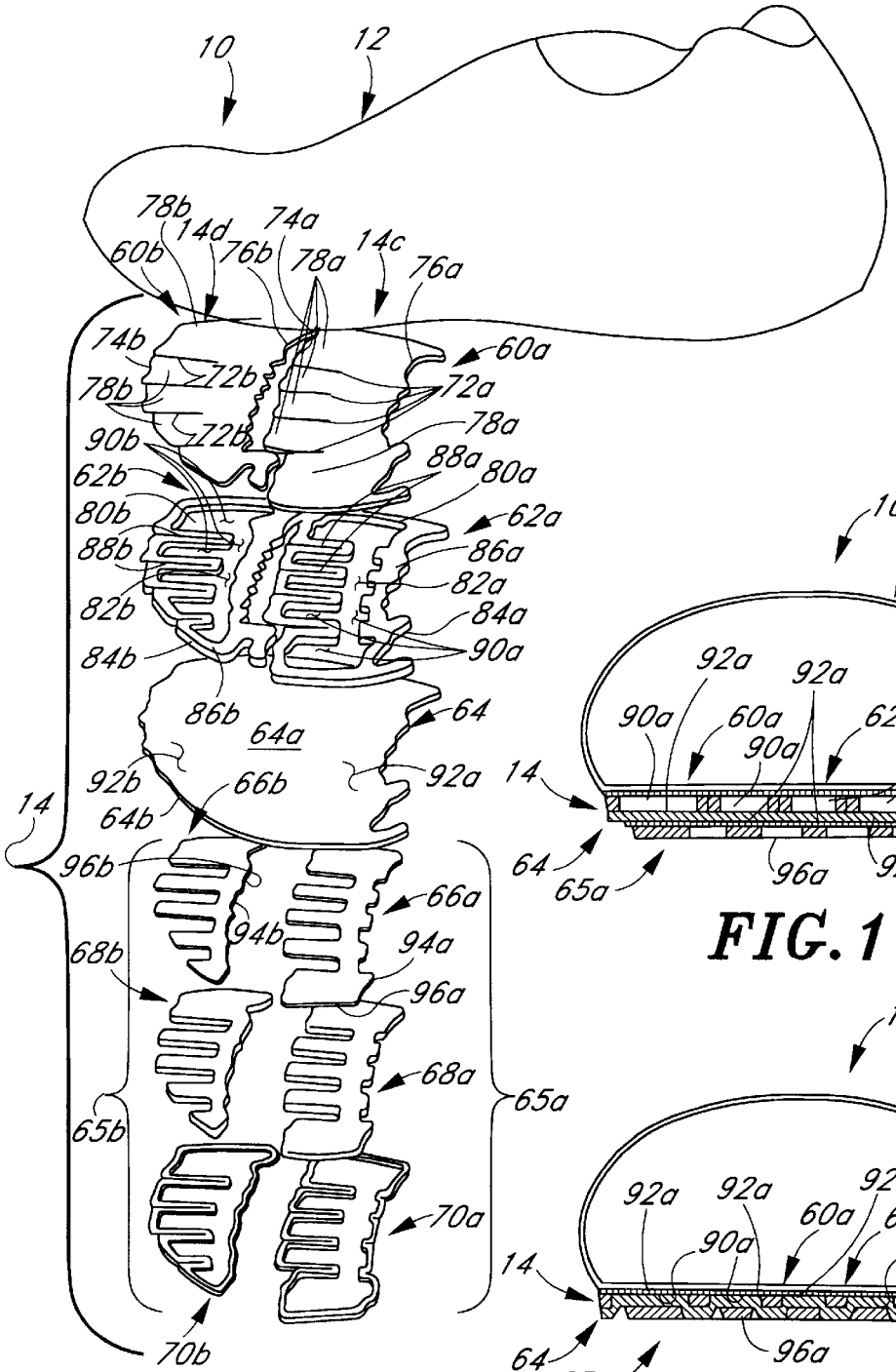
FIG. 9 is an exploded top perspective view of the metatarsel and toe regions of the sole construction of the present invention.

Referring to FIGS. 2, 3 and 8, the lower stretch layer 22 is in the form of a flexible thin substantially flat stretchable sheet 48 of resilient elastic material, such as rubber, attached in any suitable manner, such as by gluing, to a bottom surface 40G of the flat support plate 40 of the upper thruster layer 20. The lower thrustor layer 24 disposed below the flat stretchable sheet 48 of the lower stretch layer 22 includes a thrustor plate 50, a thrustor cap 52 and a retainer ring 54. The thrustor plate 50 preferably is made of a suitable semi-rigid semi-flexible thin stiff material, such as fiberglass. The thrustor plate 50 is bonded to the bottom surface of a central portion 48A of the stretchable sheet 48 in alignment with the central hole 42 in the support plate 40 of the upper thrustor layer 20. In operative stacked relationsip of the stretchable sheet 48 of the lower stretch layer 22 between the stretch-generating thrustor plate 50 of the lower thrustor layer 24 and the support plate 40 of the upper thrustor layer 20, the periphery 48B of the central portion 48A of the stretchable sheet 48 overlies the peripheral edge 50A of the stretch-generating thrustor plate 50 and underlie the rim 40C of the support plate 40.

Figure 5:
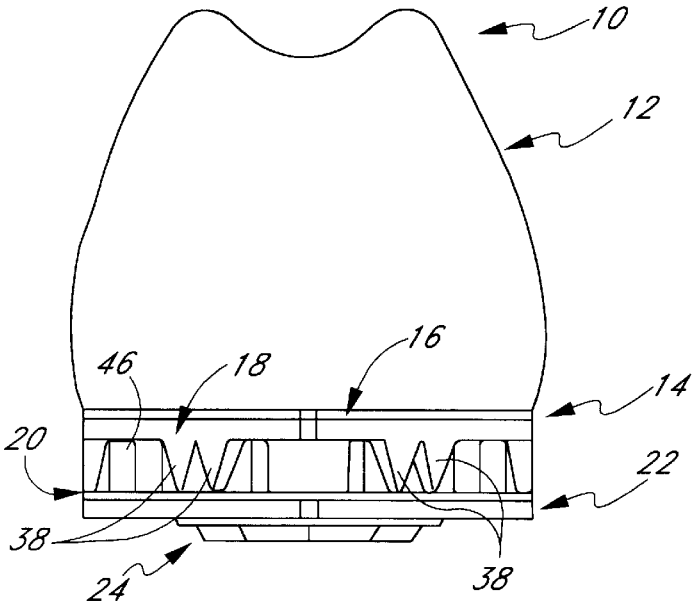
FIG. 5 is a rear end view of the heel region of the sole construction shown in a relaxed condition.
Figure 6:
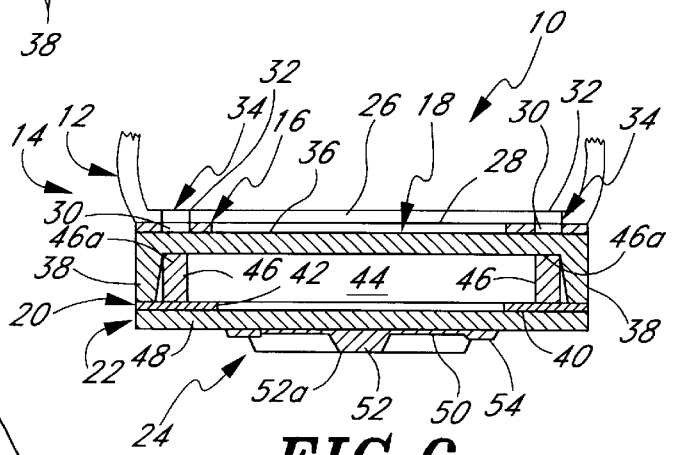
FIG. 6 is a vertical transverse sectional view of the sole construction of FIG. 5.
Figure 7:
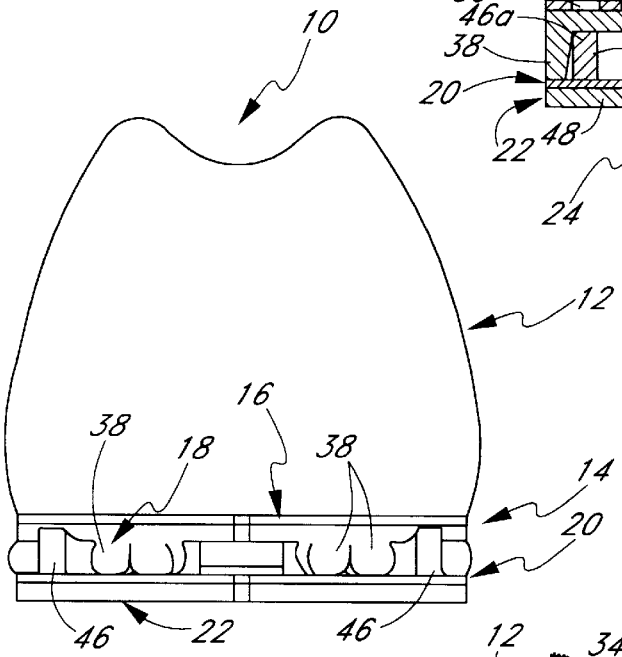
FIG. 7 is a rear end view of the heel region of the sole construction shown in a loaded condition.

Upon compression of the lower thrustor layer 24 toward the upper thrustor layer 20 from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface during normal activity, the periphery 48B of the stretchable sheet 48 is forceably stretched by the peripheral edge 50A of the thrustor plate 50 upwardly past the rim 40C surrounding the central hole 42 and into the main central stretch chamber 44. This can occur due to the fact that the thrustor plate 50 is enough smaller in its footprint size than that of the central hole 42 in the support plate 40 so as to enable the thrustor plate 50 together with the periphery 48B of the central portion 48A of the stretchable sheet 48 stretched over the thrustor plate 50 to move and penetrate upwardly through the central hole 42 and into the main centrally-located stretch chamber 44, as shown in FIGS. 7 and 8.

The rigidity of the thrustor plate 50 of the lower thrustor layer 24 encourages a stable uniform movement and penetration of the thrustor plate 50 and resultant stretching of the periphery 48B of the central portion 48A of the stretchable sheet 48 into the main central stretch chamber 44 in response to the application of compressive forces. The thrustor cap 52 is bonded on the bottom surface 50A of the thrustor plate 50 and preferably is made of a flexible plastic or hard rubber and its thickness partially determines the depth of penetration and length of drive or rebound of the thrustor plate 50. The ground engaging surface 52A of the thrustor cap 52 is generally domed shape and presents a smaller footprint than that of the thrustor plate 50. The retainer ring 54 is preferably made of the same material as the thrustor plate 50 and surrounds the thrustor plate 50 and thrustor cap 52. The retainer ring 54 is bonded on the bottom surface of the stretchable sheet 48 in alignment with the central hole 42 in the support plate 40 and surrounds the thrustor plate 50 so as to increase the stretch resistance of the central portion 48A of the stretchable sheet 48 and stabilize the lower thrustor layer 24 in the horizontal plane reducing the potential of jamming or binding of the thrustor plate 50 as it stretches the periphery 48B of the central portion 48A of the stretchable sheet 48 through the central hole 42 in the flat support plate 40 of the upper thrustor layer 20.

The above-described centrally-located interactions in the heel and midfoot regions 14A, 14B of the sole 14 between the support plate 40 of the upper thrustor layer 20, the flat stretchable sheet of the lower stretch layer 22 and flat thrustor plate of the lower thrustor layer 24 of the heel and midfoot regions 14A, 14B occur concurrently and interrelatedly with the peripherally-located interactions between footbed layer 16, the flat stretchable body 36 of the upper stretch layer 18 and the thrustor lugs 46 of the upper thrustor layer 20. These interrelated central and peripheral interactions convert the energy applied to the heel and midfoot regions 14A, 14B of the sole 14 by the wearer's foot into mechanical stretch. The applied energy is thus temporarily stored in the form of concurrent mechanical stretching of the central portion 48A of the lower stretchable sheet 48 of the lower stretch layer 22 and of the spaced portions 36C of the upper stretchable body 36 of the upper stretch layer 18 at the respective sites of the centrally-located and peripherally-located stretch chambers 44, 34. The stored applied energy is thereafter retrieved in the form of concurrent rebound of the stretched portions 36C of the upper stretchable body 36 and the thrustor lugs 46 therewith and of the stretched portion 48A of the lower stretchable sheet 48 and the thrustor plate 40 therewith. The resistance and speed of these stretching and rebound interactions is determined and controlled by the size relationship between the retainer ring 54 and the rim 40C about the central hole 42 of the support plate 49 and between the top ends 46A of the thrustor lugs 46 and the continuous interior edges 26D encompassing the slots 30 of the foundation plate 26. The thickness and elastic qualities preselected for the lower stretchable sheet 48 of the lower stretch layer 22 and the upper stretchable body 36 of the upper stretch layer 18 influence and mediate the resistance and speed of these interactions. The stretching and rebound of the lower stretchable sheet 48 also causes a torquing of the support plate 40. The torquing can be controlled by the thickness of the support plate 40 as well as by the size and thickness of the retainer ring 54.

Referring to FIG. 3, the midfoot region 14B of the sole 14 of the present invention also includes a curved midfoot piece 56 and a compression midfoot piece 58 complementary to the curved midfoot piece 56. The midfoot portion 26B of the foundation plate 26 terminates at the forward end 26E which has a generally V-shaped configuration. The curved midfoot piece 56 preferably is made of graphite and is provided as a component separate from the foundation plate 26. The curved midfoot piece 56 has a configuration which is complementary to and fits with the forward end 26E of the foundation plate 26. The forward end 26E of the foundation plate 26 cradles the number five metatarsal bone of the forefoot as the curved midfoot piece 56 couples the heel and forefoot portions 14A, 14B of the sole 14 so as to load the bones of the forefoot in an independent manner. The peripheral profiles of the upper stretch layer 18 and compression midfoot piece 58 are generally the same as those of the foundation plate 26 and curved midfoot piece 56.

Referring now to FIGS. 1, 2 and 9 to 11, the metatarsel and toe regions 14C, 14D of the sole 14 basically include the stacked combinations of metatarsel and toe articulated plates 60A, 60B, metatarsel and toe foundation plates 62A, 62B, a common metatarsel and toe stretch layer 64, and metatarsel and toe thrustor layers 65A, 65B. The metatarsel and toe thrustor layers 65A, 65B include metatarsel and toe plates 66A, 66B, metatarsel and toe thrustor caps 68A, 68B and metatarsel and toe retainer rings 70A, 70B. Except for a common stretch layer 64 serving both metatarsel and toe regions 14C, 14D of the sole 14, there is one stacked combination of components in the metatarsel region 14C of the sole 14 that underlies the five metatarsals of the wearer's foot and another separate stacked combination of components in the toe region 14D of the sole 14 that underlies the five toes of the wearer's foot. Except for the upper articulated plates 60A, 60B, the above-mentioned stacked combinations of components of the metatarsel and toe regions 14C, 14D of the sole 14 interact (stretching and rebound) generally similarly to the above-described interaction (stretching and rebound) of the stacked combination of components of the heel and midfoot regions 14A, 14B of the sole 14. However, whereas the stacked combination of components of the heel and midfoot regions 14A, 14B provide interrelated main and peripheral sites for temporary storage and retrieval of the applied energy, the stacked combination of components of the metatarsel and toe regions 14C, 14D provide a plurality of relatively independent sites for temporary storage and retrieval of the applied energy at the individual metatarsals and toes of the wearer's foot. The additional components, namely, the articulated plates 60A, 60B, of the metatarsel and toe regions 14C, 14D each has a plurality of laterally spaced slits 72A, 72B formed therein extending from the forward edges 74A, 74B rearwardly to about midway between the forward edges 74A, 74B and rearward edges 76A, 76B of the articulated plates 60A, 60B. These pluralities of spaced slits 72A, 72B define independent deflectable or articulatable appendages 78A, 78B on the metatarsel and toe articulated plates 60A, 60B that correspond to the individual metatarsels and toes of the wearer's foot and overlie and augment the independent characteristic of the respective sites of temporary storage and retrieval of the applied energy at the individual metatarsals and toes of the wearer's foot.

More particularly, the metatarsel and toe articulated plates 60A, 60B are substantially flat and made of a suitable semi-rigid semi-flexible thin stiff material, such as graphite, while the metatarsel and toe foundation plates 62A, 62B disposed below the metatarsel and toe articulated plates 60A, 60B are substantially flat and made of a incompressible flexible material, such as plastic. Each of the metatarsel and toe foundation plates 62A, 62B has a continuous interior edge 80A, 80B defining a plurality of interconnected interior slots 82A, 82B which are matched to the metatarsels and toes of the wearer's foot. The continuous interior edges 80A, 80B are spaced inwardly from located inwardly from the peripheries 84A, 84B of the metatarsel and toe foundation plates 62A, 62B so as to leave continous solid narrow borders 86A, 86B respectively adjacent to the peripheries 84A, 84B. The metatarsel and toe portions of the borders 86A, 86B encompassing or outlining the locations of the separate metatarsels and toes of the wearer's foot and of the appendages 78A, 78B on the articulated plates 60A, 60B are also separated by narrow slits 88A, 88B. The pluralities of interconnected interior slots 82A, 82B define corresponding pluralities of metatarsel and toe stretch chambers 90A, 90B in the respective metatarsel and toe foundation plates 62A, 62B.

The common metatarsel and toe stretch layer 64 is made of a suitable elastic stretchable material, such as rubber, and is disposed below the metatarsel and toe foundation plates 62A, 62B. The peripheral profile of the common stretch layer 64 generally matches the peripheral profiles of the articulated plates 60A, 60B and of the foundation plates 62A, 62B so as to provide the sole 14 with a common profile when these components are in an operative stacked relationship with one on top of the other. The common stretch layer 64 is attached at its upper surface 64A to the respective continuous bordens 86A, 86B of the foundation plates 62A, 62B between their respective continuous interior edges 80A, 80B and peripheries 84A, 84B.

The metatarsel and toe thrustor plates 66A, 66B are disposed below and aligned with the common stretch layer 64 and the pluralities of interconnected interior slots 82A, 82B in foundation plates 62A, 62B forming the metatarsel and toe stretch chambers 90A, 90B. The metatarsel and toe thrustor plates 66A, 66B are made of semi-rigid semi-flexible thin stiff material, such as fiberglass. The metatarsel and toe thrustor plates 66A, 66B are bonded to the lower surface 64B of the common stretch layer 64 in alignment with the pluralities of interconnected interior slots 82A, 82B of forming the metatarsel and toe stretch chambers 90A, 90B of the foundation plates 62A, 62B. In the operative stacked relationship of the common stretch layer 64 between the stretch-generating metatarsel and toe thrustor plates 66A, 66B and the respective metatarsel and toe foundation plates 62A, 62B, portions 92A, 92B of the common stretch layer 64 overlie the peripheral edges 94A, 94B of the metatarsel and toe thrustor plates 66A, 66B and underlie the continuous interior edges 80A, 80B of the metatarsel and toe foundation plates 62A, 62B.

Figure 10:
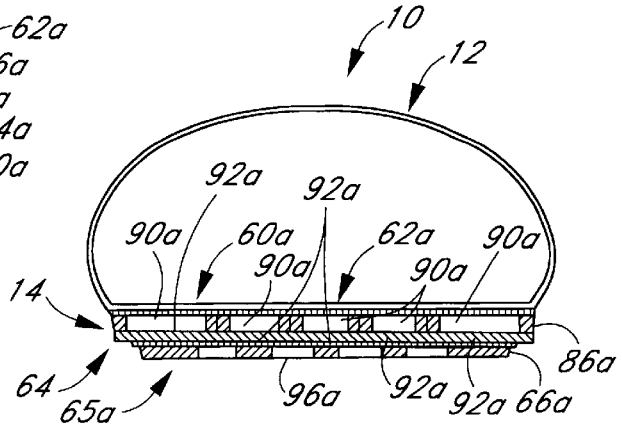
FIG. 10 is a vertical transverse sectional view of the metatarsel region of the sole construction shown in a relaxed condition.
Figure 11:
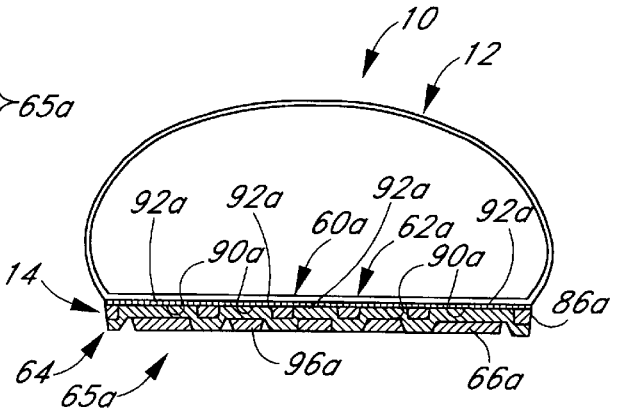
FIG. 11 is a vertical transverse sectional view of the metatarsel region of the sole construction shown in a loaded condition.

Upon compression of the lower metatarsel and toe thrustor plates 66A, 66B toward the upper metatarsel and toe foundation plates 62A, 62B from a relaxed condition shown in FIG. 10 toward a loaded condition shown in FIG. 11, as occurs upon impact of the metatarsel and toe regions 14C, 14D of the sole 14 of the shoe 10 with a support surface during normal activity, the portions 92A, 92B of the common stretch layer 64 are forceably stretched by the peripheries 94A, 94B of the metatarsel and toe thrustor plates 66A, 66B upwardly past the continuous interior edges 80A, 80B of the metatarsel and toe foundation plates 62A, 62B into the metatarsel and toe stretch chambers 90A, 90B. This can occur due to the fact that the metatarsel and toe thrustor plates 66A, 66B are enough smaller in their respective footprint sizes than the sizes of the slots 82A, 82B in the metatarsel and toe foundation plates 62A, 62B so as to enable the metatarsel and toe thrustor plates 66A, 66B together with the portions 92A, 92B of the common stretch layer 64 stretched over the respective thrustor plates 66A, 66B to move and penetrate upwardly through the slots 82A, 82B and into the metatarsel and toe stretch chambers 90A, 90B, as shown in FIG. 11.

The rigidity of the metatarsel and toe thrustor plates 66A, 66B encourages a stable uniform movement and penetration of the thrustor plates 66A, 66B and resultant stretching of the portions 92A, 92B of the common stretch layer 64 into the metatarsel and toe stretch chambers 90A, 90B in response to the application of compressive forces. The metatarsel and toe thrustor caps 68A, 68B are bonded respectively on the bottom surfaces 96A, 96B of the metatarsel and toe thrustor plates 66A, 66B and preferably is made of a flexible plastic or hard rubber and their respective thicknesses partially determine the depth of penetration and length of drive or rebound of the metatarsel and toe thrustor plates 66A, 66B. The metatarsel and toe retainer rings 70A, 70B are preferably made of the same material as the metatarsel and toe thrustor plates 66A, 66B and surround the respective thrustor plates 66A, 66B and thrustor caps 68A, 68B. The metatarsel and toe retainer rings 70A, 70B are bonded on the lower surface 64B of the common stretch layer 64 in alignment with the interior slots 82A, 82B and surround the thrustor plates 66A, 66B so as to increase the stretch resistance of the portion 92A, 92B of the common stretch layer 64 and stabilize the metatarsel and toe thrustor plates 66A, 66B in the horizontal plane reducing the potential of jamming or binding of the thrustor plates 66A, 66B as they stretch the peripheries of the portions 92*a*, 92B of the common stretch layer 64 into the metatarsel and toe stretch chambers 90A, 90*b* in the metatarsel and toe foundation plates 62A, 62B.

The above-described plurality of stretching interactions between the metatarsel and toe foundation plates 62A, 62B, common stretch layer 64 and metatarsel and toe thrustor plates 66A, 66B of the metatarsel and toe regions 14C, 14D in their stacked relationship converts the energy applied to the metatarsels and toes by the wearer's foot into mechanical stretch. The applied energy is stored in the form of mechanical stretching of the metatarsel and toe portions 92A, 92B of the common stretch layer 64 at the respective sites of the metatarsel and toe stretch chambers 90A, 90B. The applied energy is retrieved in the form of rebound of the stretched portions 92A, 92B of the common stretch layer 64 and the thrustor plates 66A, 66*b* therewith. The resistance and speed of these stretching interactions is determined and controlled by the size relationship between the retainer rings 70A, 70B and the continuous interior edges 80A, 80B in the metatarsel and toe foundation plates 62A, 62B. The thickness and elastic qualities preselected for the common stretch layer 64 influence and mediate the resistance and speed of these interactions. The peripheral profiles of the metatarsel and toe thrustor plates 66A, 66B are generally the same. The previously described midfoot pieces 56, 58 also provide a bridge between the components of the heel and midfoot regions 14A, 14B of the sole 14 and the components of the metatarsel and toe regions 14C, 14D of the sole 14.

Preliminary experimental treadmill comparative testing of a skilled runner wearing prototype footwear 10 having soles 14 constructed in accordance with the present invention with the same runner wearing premium quality conventional footwear, has demonstrated a significantly improved performance of the runner while wearing the prototype footwear in terms of the runner's oxygen intake requirements. The prototype footwear 10 compared to the conventional footwear allowed the runner to use from ten to twenty percent less oxygen running at the same treadmill speed. The dramatically reduced oxygen intake requirement can only be attributed to an equally dramatic improvement of the energy efficiency that the runner experienced while wearing the footwear 10 having the heel construction of the present invention. It is reasonable to expect that this dramatic improvement in energy efficiency will translate into dramatic improvement in runner performance as should be reflected in elapsed times recorded in running competitions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. In an athletic footwear having an upper and a sole, said sole having heel and midfoot regions wherein said sole comprises:

(a) foundation layer made of a semi-flexible material, attached to said upper, and defining a plurality of peripherally-located stretch chambers underlying a heel and midfoot of a wearer's foot, wherein said peripherally-located stretch chambers are defined by a plurality of elongated slots formed in a spaced apart end-to-end generally U-shaped arrangement in said foundation layer;

(b) a stretch layer attached to said foundation layer and having portions made of elastic stretchable material underlying said peripherally-located stretch chambers of said foundation layer; and (c) a thrustor layer attached to said stretch layer and having thrustor portions made of stiff material underlying and aligned with said peripherally-ally-located stretch chambers of said foundation layer and with said portions of said stretch layer disposed between said thrustor layer and said foundation layer such that interactions can occur between said upper layer, stretch layer and thrustor layer in response to compressive forces applied thereto upon contact of said heel and midfoot regions of said sole with a support surface so as to convert and temporarily store energy applied to said heel and midfoot regions of said sole by a wearer's foot into mechanical stretching of said portions of said stretch layer into said peripherally located stretch chambers, said stored applied energy being thereafter retrieved in the form of rebound of said stretched portions of said stretch layer and said store portions of said thrustor layer therewith;

wherein said stretch layer includes a flexible substantially flat stretchable body and a plurality of compressible lugs formed on and projecting downwardly from said flat stretchable body at the periphery thereof to said thrustor layer.

2. The sole of claim 1 wherein said thrustor layer includes a substantially flat support plate and a plurality of stretch-generating thrustor lugs formed on and projecting upwardly from said support plate at the periphery thereof and defining said thrustor portions of said thrustor layer, said stretch-generating thrustor lugs being disposed in a spaced apart end-to-end arrangement corresponding to and in alignment with said slots in said foundation plate and thus with said peripherally-located stretch chambers defined by said slots such that upon compression of said foundation layer and thrustor layer toward one another from a relaxed condition toward a loaded condition as occurs upon impact of said heel and midfoot regions of said sole of said footwear with a support surface, spaced portions of said flat stretchable body are forcibly stretched by movement of said thrustor lugs upwardly toward and into said peripherally-located stretch chambers.

3. The sole of claim 2 wherein said thrustor lugs are sized so as to enable said thrustor lugs together with said stretchable portions of said flat stretchable body to move and penetrate and stretch upwardly through said slots and into said peripherally-located stretch chambers.

4. The sole of claim 2 wherein said compressible lugs of said stretch layer are located in alignment with said support plate outside of said thrustor lugs and projecting downwardly toward said support plate such that compressive force applied to said foundation layer and thrustor layer causes compression of said compressible lugs from an uncompressed condition into a compressed condition in balancing resistance and rebound qualities of said heel and midfoot regions of said heel.

5. The sole of claim 2 wherein said stretch-generating thrustor lugs are generally greater in height at a heel portion of said support plate than at a midfoot portion thereof so as to produce a wedge shape from said heel region to said midfoot region of said sole for effectively generating and guiding a forward and upward thrust for the user's foot.

6. In an athletic footwear having an upper and a sole, said sole having heel and midfoot regions wherein said sole comprises:

(a) a foundation layer made of a semi-flexible material, attached to said upper, and defining a centrally-located stretch chamber underlying a heel of a wearer's foot, wherein said foundation layer has a central hole defined therein providing an entrance to a space constituting said centrally-located stretch chamber;

(b) a stretch layer attached to said foundation layer and having a central portion made of elastic stretchable material underlying said centrally-located stretch chamber of said foundation layer, wherein said stretch layer is in the form of a flexible thin substantially flat stretchable sheet attached to a bottom surface of said foundation layer and extending across said central hole defined therein; and (c) a thrustor layer attached to said stretch layer and having a central thrustor portion made of stiff material underlying and aligned with said centrally-located stretch chamber of said foundation layer and with said central portion of said stretch layer disposed between said thrustor layer and said foundation layer such that interaction can occur between said foundation layer, stretch layer and thrustor layer in response to compressive forces applied thereto upon contact of said heel and midfoot regions of said sole with a support surface so as to convert and store energy applied to said heel and midfoot regions of said sole by a wearer's foot into mechanical stretching of said central portion of said stretch layer into said centrally-located stretch chamber, said stored applied energy being thereafter retrieved in the form of rebound of said stretched central portion of said stretch layer and said thrustor portion of said thrustor layer therewith;

wherein said thrustor layer is disposed below said flat stretchable sheet and includes a thrustor plate having a peripheral profile matching that of said central hole of said foundation layer and attached to a bottom surface of a central portion of said stretchable sheet in alignment with said central hole in said foundation layer such that upon compression of said thrustor layer toward said foundation layer from a relaxed condition toward a loaded condition of said sole, as occurs upon impact of said heel and midfoot regions of said sole of said footwear with the support surface during normal activity, said central portion of said stretchable sheet is forcibly stretched by said thrustor layer upwardly into said centrally-located stretch chamber.

7. The sole of claim 6 wherein said thrustor layer further includes a thrustor cap attached on a bottom surface of said thrustor plate and made of a flexible material, said thrustor cap having a thickness selected to at least partially determine depth of penetration and length of drive and rebound of said thrustor plate.

8. The sole of claim 7 wherein said thrustor cap has a ground engaging surface generally of domed shape and presenting a smaller footprint than that of said thrustor plate.

9. The sole of claim 7 wherein said thrustor layer further includes a retainer ring surrounding said thrustor plate and thrustor cap, said retainer ring being attached to a bottom surface of said stretchable sheet outside of said periphery of and surrounding said thrustor plate so as to increase the stretch resistance of said central portion of said stretchable sheet and stabilize said lower thrustor layer in a horizontal plane reducing the potential of binding of said thrustor plate as it stretches said central portion of said stretchable sheet through said central hole in said foundation layer of said thrustor layer and into said centrally-located stretch chamber.

10. In an athletic footwear having an upper and a sole, said sole having heel and midfoot regions wherein said sole comprises:

(a) a footbed layer made of a semi-flexible material, attached to said upper, and defining a plurality of peripherally-located stretch chambers underlying a heel and midfoot of a wearer's foot;

(b) an upper stretch layer attached to said footbed layer and having portions made of elastic stretchable material underlying said peripherally-located stretch chambers of said footbed layer;

(c) an upper thrustor layer attached to said upper stretch layer and having peripheral portions made of stiff material underlying and aligned with said peripherally-located stretch chambers of said footbed layer and with said portions of said upper stretch layer disposed between said upper thrustor layer and said footbed layer, said upper thrustor layer also having a central hole formed therein defining a centrally-located stretch chamber underlying the heel of the wearer's foot;

(d) a lower stretch layer attached to said upper thrustor layer and having a central portion made of elastic stretchable material and underlying said centrally-located stretch chamber of said upper thrustor layer; and (e) a lower thrustor layer attached to said lower stretch layer and having a central thruster portion made of stiff material underlying and aligned with said centrally-located stretch chamber of said upper thrustor layer and with said central portion of said lower stretch layer disposed between said lower thrustor layer and said upper thrustor layer such that interaction in said heel and midfoot regions of said sole between said upper thrustor layer, lower stretch layer and lower thrustor layer occur concurrently with interactions between said footbed layer, upper stretch layer and upper thrustor layer in response to compressive forces applied thereto upon contact of said heel and midfoot regions of said sole with a support surface so as to convert and store energy applied to said heel and midfoot regions of said sole by a wearer's foot into concurrent mechanical stretching of said central portion of said lower stretch layer and of said spaced portions of said upper stretch layer respectively in said centrally-located and peripherally-located stretch chambers, said stored applied energy is thereafter retrieved in the form of concurrent rebound of said stretched central portion of said lower stretch layer and said central thrustor portion of said lower thrustor layer and of said stretched spaced peripheral portions of said upper stretch layer and said peripheral thrustor portions therewith.

11. The sole of claim 10 wherein said footbed layer, upper stretch layer, upper thrustor layer, lower stretch layer and lower thrustor layer are provided in the aforesaid sequence in vertically stacked arrangement with said footbed layer located closest to said upper of said footwear and said lower thrustor layer located farthest from said upper of said footwear.

12. In an athletic footwear having an upper and sole, said sole having metatarsal and toe regions wherein said sole comprises:

(a) a pair of foundation layers each made of semiflexible material, attached to said upper and defining a plurality of stretch chambers respectively underling metatarsals and toes of a wearer;

(b) a common stretch layer attached to each of said foundation layers and having portions of elastic stretchable material underlying said stretch chambers of a respective one of said foundation layers; and (c) a pair of thrustor layers each attached to said stretch layer and having portions of stiff material underlying and aligned with a respective one of said pluralities of said stretch chambers of said foundation layers and with said portions of said stretch layer disposed between said thrustor layers and foundation layers such that interactions can occur between said respective ones of said foundation layers, stretch layers and thrustor layers of said metatarsal and toe regions of said sole in response to compressive forces applied thereto upon contact of said metatarsal and toe regions of said sole with a support surface that convert and temporarily store energy applied to said metatarsal and toe regions of said sole by a wearer's foot into mechanical stretching of said portions of said respective stretch layers into said stretch chambers, said stored applied energy thereafter being retrieved in the form of rebound of said stretched portions of said respective stretch layers and portions of said respective thrustor layers therewith;

wherein each of said thrustor layers includes a thrustor plate having a peripheral profile matching that of said interconnected interior slots in a respective one of said foundation layers and attached to a bottom surface of a respective central portion of said common stretch layer in alignment with said interior slots in said respective one foundation layer such that upon compression of said thrustor layers toward said foundation layers from a relaxed condition toward a loaded condition of said sole, as occurs upon impact of said metatarsal and toe regions of said sole of said footwear with the support surface during normal activity, said central portions of said common stretch layer are forcibly stretched by said thrustor plates upwardly into said stretch chambers underlying said metatarsals and toes of the wearer's foot.

13. The sole of claim 12 wherein each of said thrustor layers further includes a thrustor cap attached on a bottom surface of said thrustor plate and made of a flexible material, said thrustor cap having a thickness selected to at least partially determine depth of penetration and length of drive and rebound of said respective thrustor plates.

14. The sole of claim 13 wherein each of said thrustor layers further includes a retainer ring surrounding said respective thrustor plate and thrustor cap, said retainer ring being attached to a bottom surface of said common stretch layer outside of said periphery of and surrounding said thrustor plate so as to increase the stretch resistance of said respective central portion of said common stretch layer and stabilize said thrustor layers in a horizontal plane reducing the potential of binding of said thrustor plates as they stretch said respective central portions of said common stretch layer through said slots in said respective foundation layers and into said stretch chambers underlying the metatarsels and toes of the wearer's foot.

* * * * *